US005692880A

United States Patent [19]

Zelder

[11] Patent Number: 5,692,880

[45] Date of Patent: Dec. 2, 1997

[54] IMPELLER CONTAINING A PAIR OF BLADES WHEREIN THE LEADING EDGE OF ONE OF THE BLADES IS THICKER THAN THE LEADING EDGE OF THE OTHER

[75] Inventor: Manfred Zelder, Bonn, Germany

[73] Assignee: Wilo GmbH, Dortmund, Germany

[21] Appl. No.: 662,945

[22] Filed: Jun. 13, 1996

[30] Foreign Application Priority Data

Jun. 19, 1995 [DE] Germany ..... 195 21 768.3

[51] Int. Cl.[6] ..... B63H 1/26

[52] U.S. Cl. ..... 416/203; 416/175; 416/185

[58] Field of Search ..... 416/175, 185, 416/203, 223 B

[56] References Cited

U.S. PATENT DOCUMENTS

| | | | |
|---|---|---|---|
| 553,956 | 2/1896 | Hughes | 416/203 |
| 1,754,992 | 4/1930 | Fabrin | 416/175 |
| 1,864,834 | 12/1932 | Klosson . | |
| 1,959,710 | 9/1934 | Durdin . | |
| 2,265,758 | 12/1941 | Klosson | 416/203 |
| 4,063,849 | 12/1977 | Modianos . | |
| 4,087,994 | 5/1978 | Goodlaxson | 416/188 |
| 4,293,280 | 10/1981 | Yim | 416/175 |
| 4,681,508 | 7/1987 | Kim | 415/116 |

FOREIGN PATENT DOCUMENTS

| | | |
|---|---|---|
| 0 640 768 A1 | 1/1995 | European Pat. Off. . |
| 2 053 368 A | 2/1981 | United Kingdom . |

*Primary Examiner*—Thomas E. Denion
*Attorney, Agent, or Firm*—Herbert Dubno

[57] ABSTRACT

An impeller for a submersible radial pump has an impeller disk which is formed with a pair of blades on a side thereof opposite the boss. The leading end of one of the blades is thicker than the leading end of the other blade to reduce the possibility that pieces of fabric or the like will hang up on the blades in operation of the pump.

6 Claims, 2 Drawing Sheets

IMPELLER CONTAINING A PAIR OF BLADES WHEREIN THE LEADING EDGE OF ONE OF THE BLADES IS THICKER THAN THE LEADING EDGE OF THE OTHER

FIELD OF THE INVENTION

My present invention relates to an impeller for a radial rotary pump and, more particularly to a rotor of a plunger motor pump having two arcuate blades, which are fastened to a disk in the vicinity of the impeller boss, wherein the two blades extend into the pumping area on the inlet side of the pump, without being fastened to a further impeller disk (the impeller being semi-open).

BACKGROUND OF THE INVENTION

In the field of non-clogging pumps, it is known to provide the impeller with a single blade. Such single-bladed impellers have a low efficiency and bring about a so-called hydrodynamic imbalance, which occurs due to the unsymmetric passage of the single blade across the pressure fitting. Herein, the mechanical imbalance adds to the hydrodynamic imbalance. As a result, it is known to counteract the mechanical imbalance by an unsymmetrical distribution of mass in the impeller.

This problem of imbalance does not arise with impellers having two blades. On the other hand, these blades bring about an easier clogging of the pump, especially when the pump is used for sewage containing pieces of material like fabrics. A piece of fabric could be disposed over the two blades and therefore get stuck on the blades.

OBJECTS OF THE INVENTION

It is the object of the invention to improve the non-clogging efficiency of a radial rotary pump of the kind mentioned above by means of a simple construction.

A further object of the invention is to provide an open impeller of the two-bladed type for a radial rotary pump which will eliminate the hang-up of especially textile materials upon the blades.

Still another object of this invention is to provide an impeller of the double-bladed type for a radial rotary pump and particularly a submersible pump whereby drawbacks of earlier systems are avoided.

SUMMARY OF THE INVENTION

According to the invention, this problem is solved in that the front area of the blade first meeting with the liquid or first impinging on the liquid, particularly the front edge of one of the blades, is thicker than the front area of the second blade.

In case an article which might tend to clog the pump like a piece of, especially a material, a fabric like a diaper or a panty, is flushed and engages on such a blade, the fabric will not get stuck in the middle. Rather, the blades having a different thickness at their front area will ensure that the impeller will clear the fabric from these parts rather quickly, so that the fabric can be flushed away. While in the case of an impeller having two identical blades, the clogging diaper can get stuck in the middle, in the case of an impeller having different blades, because of the different action provided by the different blades, the otherwise clogging diaper will securely flush through.

Therefore, the impeller according to the invention does not trade the provision of two blades for an increased risk of clogging. Instead the quietly working two-blade impeller of the invention is as non-clogging as an impeller having one blade.

It is especially advantageous that the thicker region in the front area of the first blade is located on the side of the blade opposite the impeller axis. Also, the thicker region should merge into the front curvature of the front edge of the blade. A reduction of the imbalance is achieved in that the imbalance produced by the thicker region is compensated by way of a mass reduction on the same side of the impeller or by way of an increase of mass on the opposite side of the impeller. It is also advantageous to make the impeller of a plastic material.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
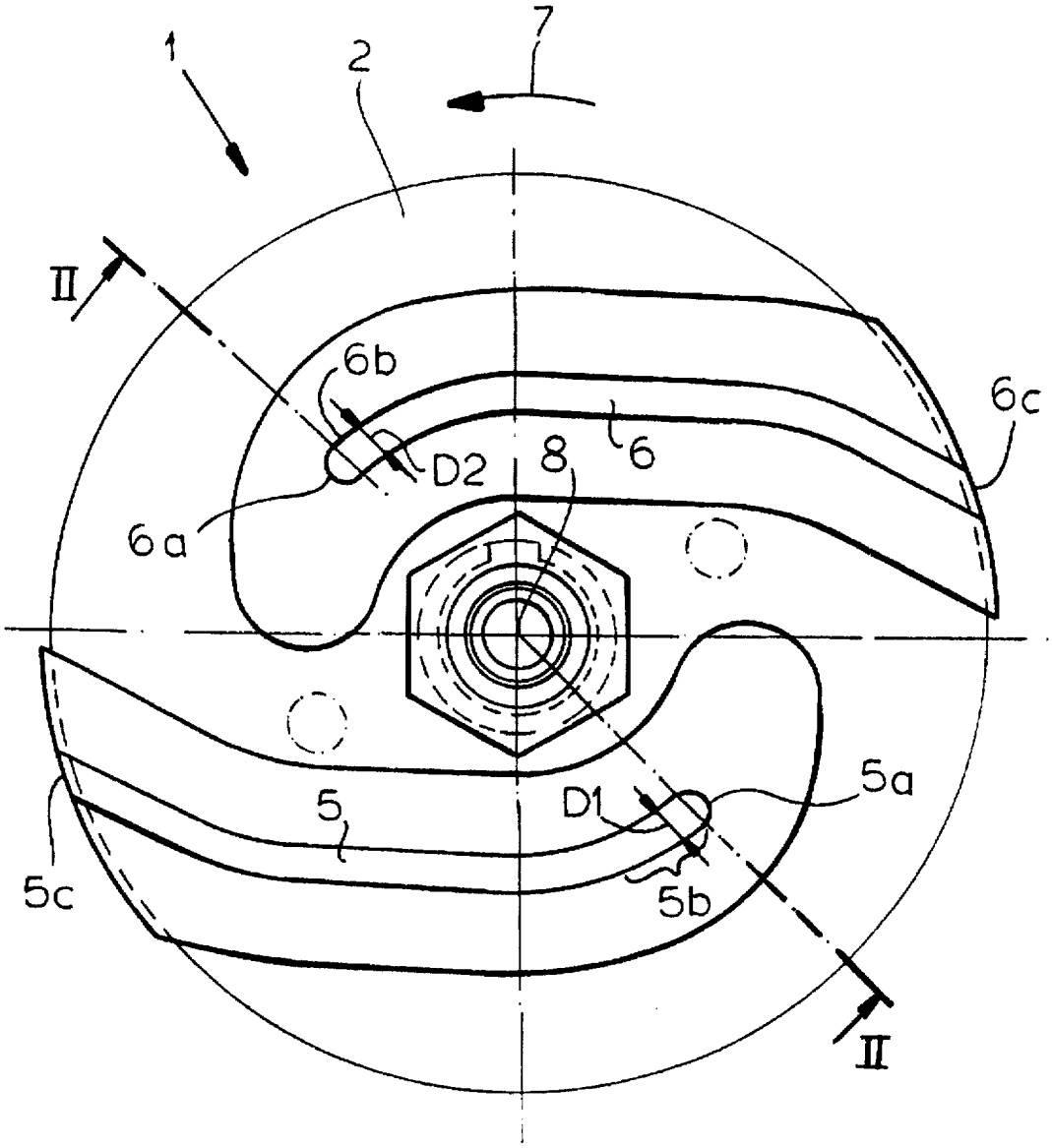
FIG. 1 is a top plan view of the impeller of the invention in a direction towards its inlet.

The impeller 1, of a radial rotary pump usable as a submersible motor pump, has a circular-shaped disk 2, at the backside of which a boss 3 is formed in which a bushing 4 may be cast in, in order to mount the impeller on the shaft of an electric motor.

On the front side of disk 2, two blades 5, 6 protrude, entering freely into the pumping chamber in such a way that a semi-open impeller is formed. The blades 5 and 6 are formed on the disk 2 made of a plastic material such that they are rotationally symmetrically juxtaposed, and they are taper shaped with respect to their thickness D in a direction towards the inlet of the pump, i.e. away from the disk.

The impeller shown in FIG. 1 turns in the direction of arrow 7, so that the front or leading edges **5*a* and 6*a* of the blades face towards the liquid to be pumped. These blade edges together with an adjacent region will be defined as the front regions 5*b*, 6*b* of the blades. Meanwhile the two blades 5, 6 are identical in all areas except for their front regions 5*b*, 6*b***. They are shaped differently in these front regions.

In one of the blades, in this case blade 5, the thickness D1 of the front region **5*b* of the blade is greater than the thickness D2 of the front area 6*b* of the second blade 6. In the embodiment illustrated, the additional material of the front region 5*b* of the first blade 5 is formed on that side of the blade which is remote to the axis 8 of the impeller 1. Even though thickness D1 is only slightly greater than the thickness D2 (0.1 mm to 4 mm, or 5–40% greater than D2), the additional non-clogging effect is considerable. The length of the thicker front area 5*b* of blade 5 is equal to 1/20 to 1/4 of the total length of the first blade 5. The thickened region merges with the curvature of the front edge 5*a* of blade 5, so that blade 5 is formed to be equally as stream-efficient as the second blade 6**.

In order to offset the imbalance introduced by the thicker region, the impeller is provided with a reduction of mass on the side of blade 5, or with an increase of mass on the side of blade 6.

Figure 2:
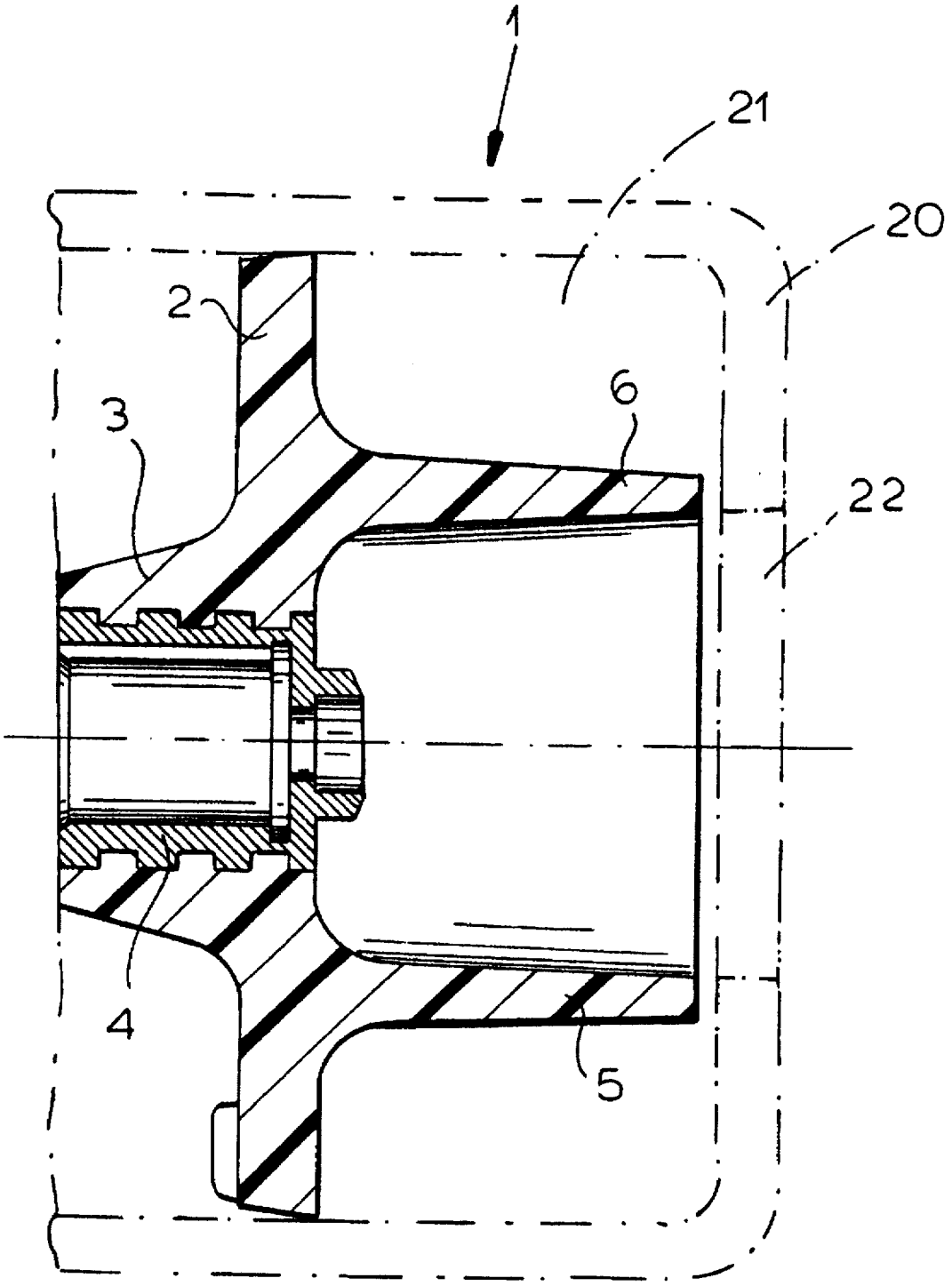
FIG. 2 is a cross section along line II—II of FIG. 1.

The pump casing has been represented at 20 in dot-dash lines in FIG. 2 and defines a pumping chamber 21 and an inlet or intake 22 for the liquid to be pumped.

I claim:

1. An impeller for a radial rotary pump, comprising:

an impeller disk;

a boss formed on one side of said impeller disk; and a pair of blades formed on an opposite side of said impeller disk, each of said blades tapering away from said disk and having a leading end in the vicinity of said boss and inwardly of a periphery of said disk, and a blade body extending curvilinearly from the respective leading end to the periphery of said disk, said leading ends being the portions of said blades first encountering liquid upon rotation of said impeller in a pumping chamber, one of said blades having a greater thickness at said leading end thereof than the thickness of the leading end of the other of said blades, said blades having free surfaces over the lengths thereof remote from said disk whereby said impeller can be open toward an inlet for said liquid into said chamber.

2. The impeller defined in claim 1 wherein said one of said blades has a thicker region at said leading end on a side of said one of said blades remote from said boss.

3. The impeller defined in claim 2 wherein said thicker region merges into a front curvature of said leading end of said one of said blades.

4. The impeller defined in claim 1 wherein imbalance created by having said leading end of said one of said blades thicker than said leading end of said other blade is compensated by a reduction of mass on a side of said impeller formed with said one of said blades.

5. The impeller defined in claim 1 wherein imbalance created by having said leading end of said one of said blades thicker than said leading end of said other blade is compensated by an increase in mass on a side of said impeller opposite said one of said blades.

6. The impeller defined in claim 1 wherein said impeller is composed of a plastic material.

* * * * *